US006991392B2

(12) United States Patent
Hult et al.

(10) Patent No.: US 6,991,392 B2
(45) Date of Patent: Jan. 31, 2006

(54) DOOR ASSEMBLY HAVING A PRINT MEDIA DELIVERY SYSTEM

(75) Inventors: Nathan E. Hult, Wilsonville, OR (US); Darryl I. Jensen, Woodburn, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/753,577

(22) Filed: Jan. 8, 2004

(65) Prior Publication Data

US 2005/0152735 A1 Jul. 14, 2005

(51) Int. Cl.
*B41J 11/58* (2006.01)

(52) U.S. Cl. ..... 400/624; 400/629; 271/117; 271/126; 271/162

(58) Field of Classification Search ..... 400/624–629; 271/114, 117, 119, 126, 162
See application file for complete search history.

(56) References Cited

U.S. PATENT DOCUMENTS 5,619,240 A * 4/1997 Pong et al. ..... 347/103
5,820,275 A 10/1998 Crawford et al.
6,070,867 A * 6/2000 Tsurumi et al. ..... 271/114

FOREIGN PATENT DOCUMENTS

JP 2000095395 * 4/2000

OTHER PUBLICATIONS

Hewlett Packard LaserJet 4200, www.hp.com.*

* cited by examiner

*Primary Examiner*—Ren Yan
*Assistant Examiner*—Marissa Ferguson
(74) *Attorney, Agent, or Firm*—Fay, Sharpe, Fagan, Minnich & McKee LLP

(57) ABSTRACT

A print media delivery system on a door assembly that is connected to an associated frame is provided. The door assembly includes a door body openable to provide access into an associated frame. A tray is pivotally connected to the door body for receiving associated print media thereon. A pick roller is rotatably mounted to the door body for contacting the associated print media and advancing the associated print media into the associated frame. A gear has a missing teeth section and is connected to the pick roller for corotation therewith. A gear bias system urges the gear to rotate in a first direction when the door body is closed and said tray is open to selectively advance the missing teeth section past an associated drive gear and allow teeth of the gear to engage the associated drive gear when the door body is closed.

21 Claims, 10 Drawing Sheets

DOOR ASSEMBLY HAVING A PRINT MEDIA DELIVERY SYSTEM

BACKGROUND

The present application relates to a door assembly having a print media delivery system. More particularly, the present application relates to a simplified door assembly with a print media delivery system that is pivotally connected to an associated frame such as found on a printing device and will be described with particular reference thereto. However, it is to be appreciated that the door assembly may be used in other similar environments and applications.

Missing teeth gear applications are frequently used in gear drive trains on printing devices. They commonly consist of a gear with a section of its teeth missing, a biased spring and a solenoid with a pawl to hold the gear in the missing teeth section. Missing teeth gear applications are common because they are an inexpensive way to implement adding another function to a gear drive train without having to add another expensive motor or an electric clutch with a position sensor. They are ideal for use in applications where only a single revolution is needed.

In printers, missing tooth gear systems are known to be used on multipurpose tray D-roller pick systems which are often provided on an openable door structure of the printer device to allow access into the printer device, as might be necessary to remove a jammed sheet of print media. However, in many (if not all) prior art implementations, the components of the D-roller pick system, i.e., the pick roller, missing tooth gear, solenoid and bias spring, are all housed in the same structure, the openable front door. When housed in the openable front door, the manufacturing costs of the printer device may be unnecessarily high and the likelihood of cable routing problems and safety issues may increase. When solenoids are required in an openable front door, longer cables are often required that may require special insulation which further increases costs. Thus, there is a need for a pick system that is relatively inexpensive and simple and can be used in areas of a printer device that render housing of all components in one structure impractical due to excessive costs or other problems.

BRIEF SUMMARY

A print media delivery system on a door assembly that is connected to an associated frame is provided. The door assembly includes a door body openable to provide access into an associated frame. A tray is pivotally connected to the door body for receiving associated print media thereon. A pick roller is rotatably mounted to the door body for contacting the associated print media and advancing the associated print media into the associated frame. A gear has a missing teeth section and is connected to the pick roller for corotation therewith. A gear bias system urges the gear to rotate in a first direction when the door body is closed and said tray is open to selectively advance the missing teeth section past an associated drive gear and allow teeth of the gear to engage the associated drive gear when the door body is closed.

DETAILED DESCRIPTION

Figure 1:
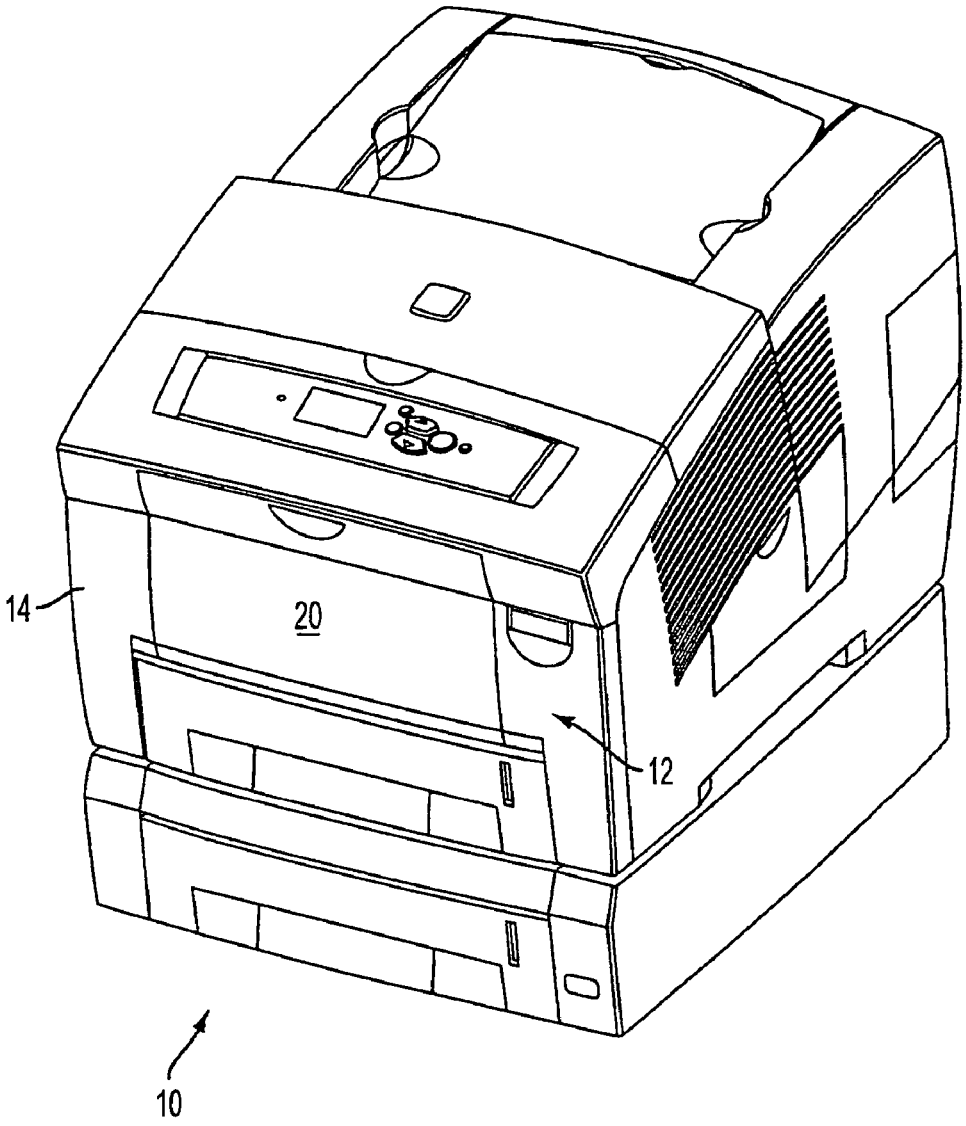
FIG. 1 is a perspective view of a printer device having a door assembly.
Figure 2:
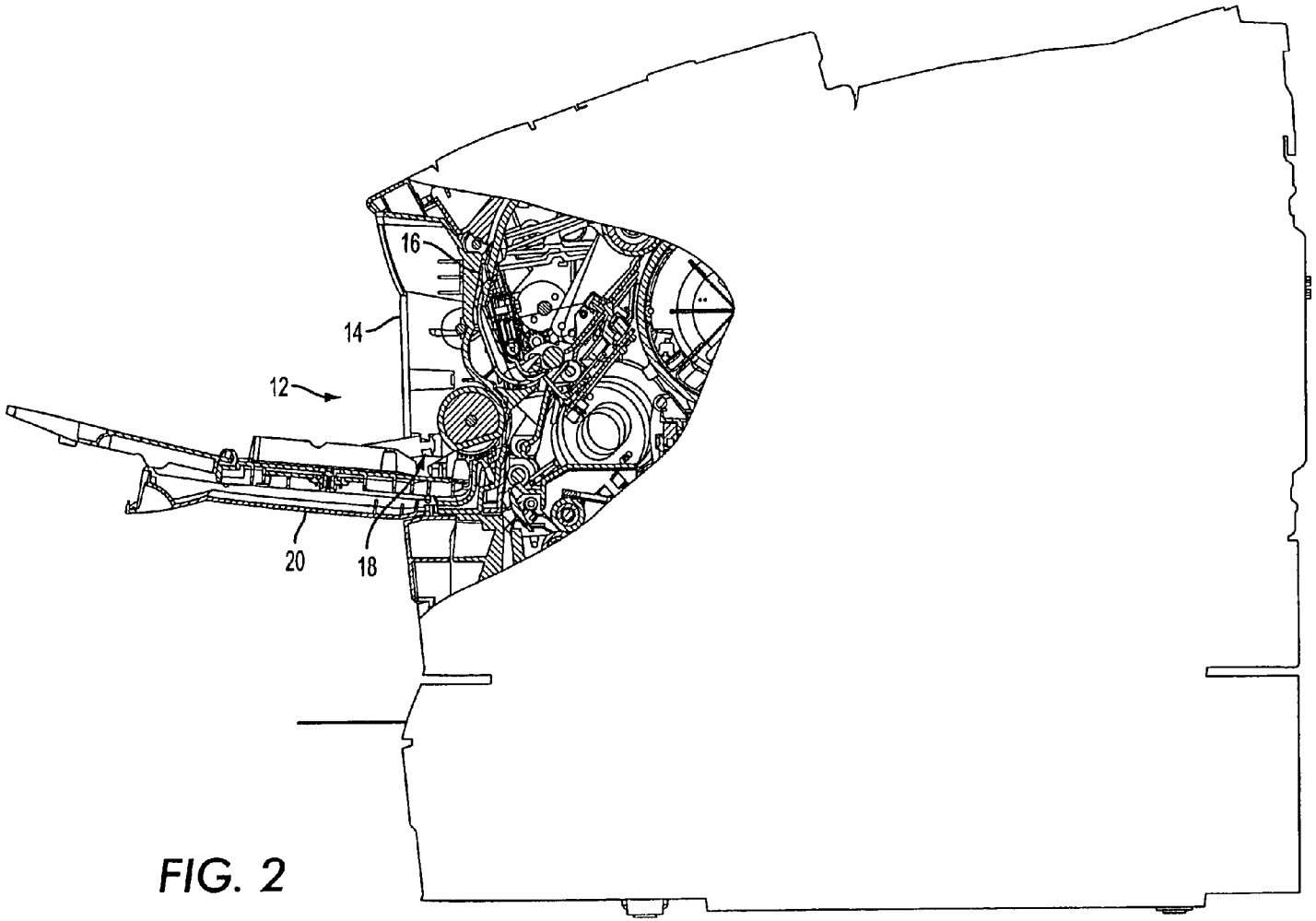
FIG. 2 is a cross-sectional view of the printer device of FIG. 1 showing a multipurpose tray of the door assembly in a tray open position.

Referring now to the drawings wherein the showings are for purposes of illustrating one embodiment and not for purposes of limiting the same, with reference to FIGS. 1 and 2, a printer device is shown and generally designated by reference numeral 10. As will be described in more detail below, the printer device 10 includes a door assembly 12 having a door body 14 that is pivotally connected to a frame 16 of the printer device 10. The door body 14 is moveable relative to the frame 16 between a door closed position and a door open position for providing access into the frame 16 such as might be necessary to clear a jam in the printer device or for servicing one or more internal components of the printer device.

Figure 3:
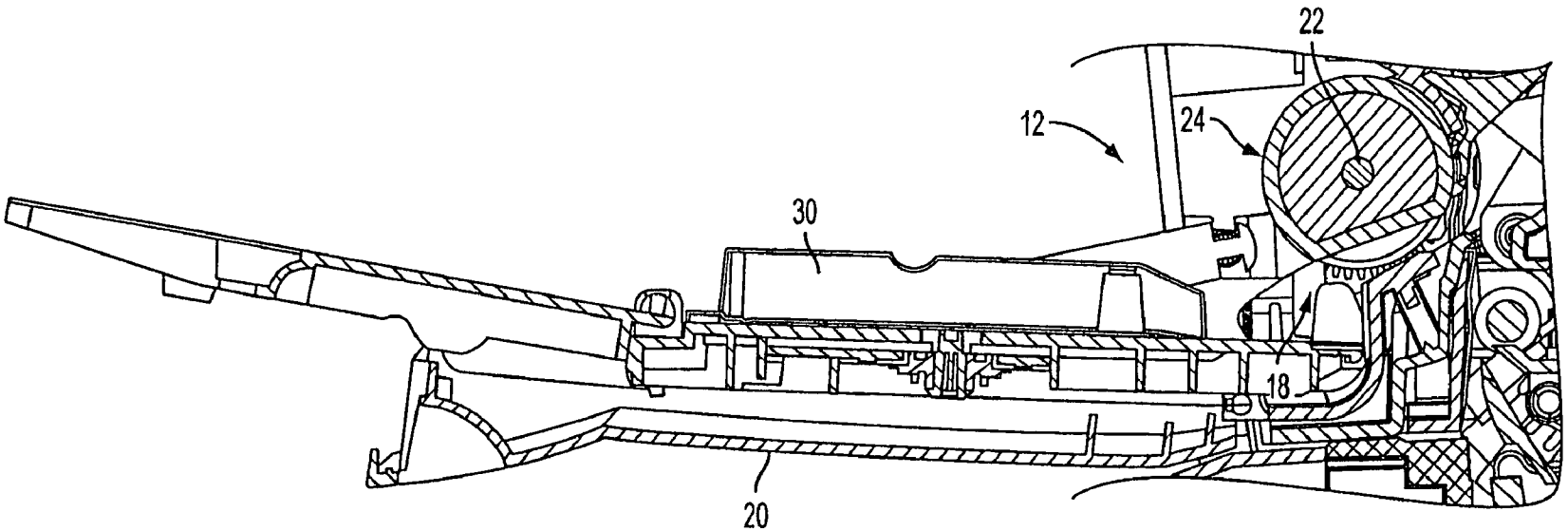
FIG. 3 is an enlarged partial cross-sectional view of the printer device of FIG. 1.

A print media delivery system 18 is provided on the door assembly 12 for receiving a relatively small stack of print media sheets, such as various grades and sizes of paper, transparencies, other print media or the like, and for separating and sequentially feeding individual print media sheets from the stack into the printer device 10 for further processing and/or printing on the fed sheets. More particularly, the print media delivery system 18 is disposed on the door body 14 or formed in conjunction therewith and, with additional reference to FIG. 3, includes a multipurpose tray 20 that is pivotally connected to the door body 14. The tray 20 is moveable relative to the door body 14 between a tray closed position (shown in FIG. 1) and a tray open position (shown in FIGS. 2 and 3). In the tray open position, the tray 20 is able to receive print media sheets thereon in a conventional manner for delivering the media sheets into the printer device 10.

Figure 4:
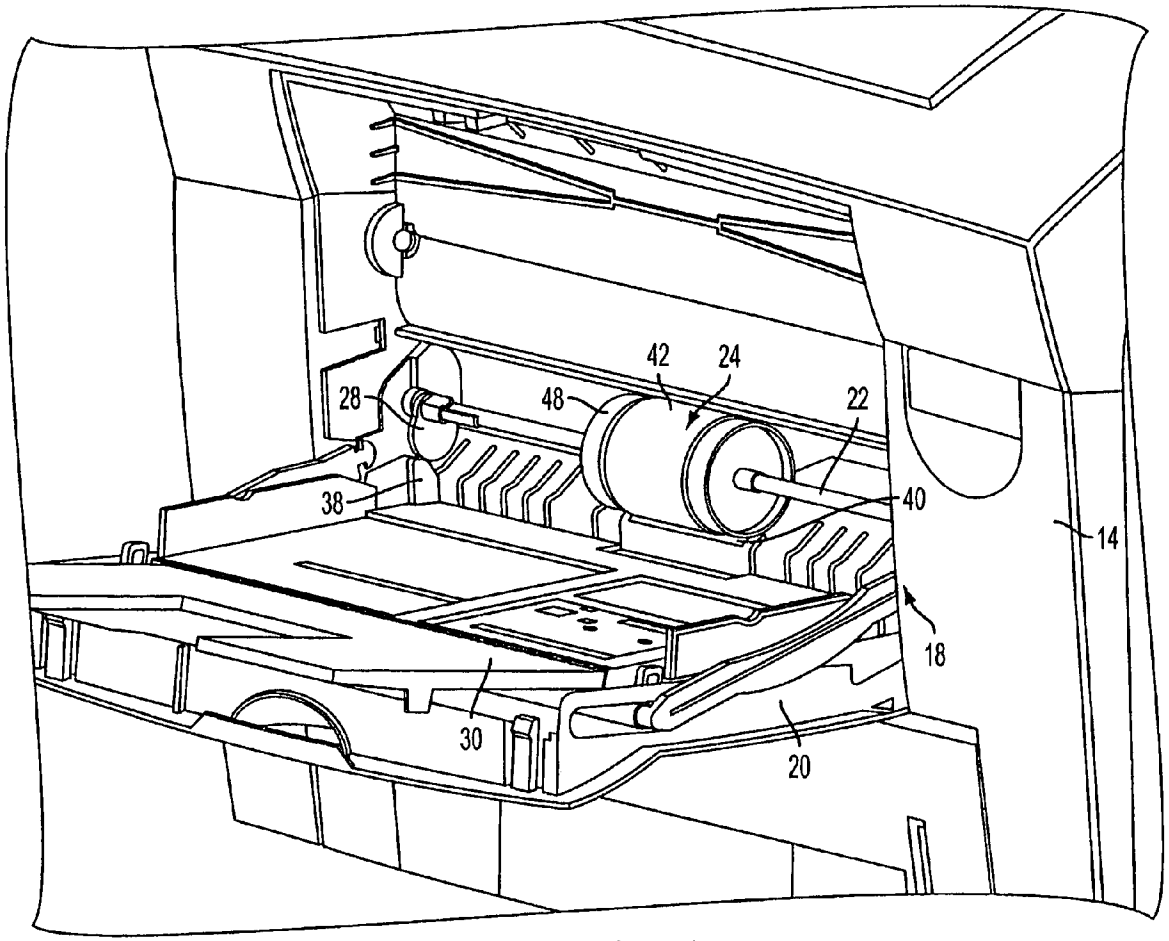
FIG. 4 is a partial perspective view of the door assembly of FIG. 1 showing a pick roller shaft having a cam and a pick roller and showing a lift plate of the multipurpose tray having a cam follower.

With additional reference to FIG. 4, the delivery system 18 further includes a pick roller shaft 22 rotatably mounted or connected to the door body 14 adjacent the tray 20. A pick roller 24 is also rotatably mounted or connected to the door body 14. More specifically, the pick roller 24 is rotatably fixed to the pick roller shaft 22 for corotation therewith. The pick roller 24 is positioned to selectively contact the top one of any number of print media sheets held in the tray 20 and to advance the top of the contacted sheets into the frame 16 for further print processing. Spaced apart from the pick roller 24, with reference to FIGS. 4 and 5, first and second cams 26,28 are rotatably fixed on or to the pick roller shaft 22, also for corotation with the pick roller shaft 22.

The tray 20 includes a lift plate 30 that operates to lift print media sheets held in the tray 20 toward and/or into contact with the pick roller 24. More particularly, the lift plate 30 is moveable between a lowered positioned wherein print media sheets held in the tray 20 are allowed to be spaced from the pick roller 24 which facilitates relatively easier loading of the print media sheets into the tray 20 and a raised position wherein the sheets are urged into or toward the pick roller 24. As will be discussed in more detail below, the tray 20 includes first and second cam followers 36,38 positioned to engage the cams 26,28 of the pick roller shaft 22 and selectively move the lift plate 30 between the lowered and raised positions.

The tray 20 further includes a separator or friction pad 40 positioned to be adjacent the pick roller 24 at least when the tray 20 is in the tray open position and the door body 14 is in the door closed position. When the pick roller 24 is in the appropriate position, a D-shaped section 42 of the pick roller 24 and the separator pad 40 together form a nip for receiving and feeding a single sheet of print media into the printer device 10 while retarding all sheets other than the top single sheet. More particularly, with additional reference to FIG. 7, the separator pad 40 forms a nip with a rounded portion 44 of the D-shaped pick roller section 42 when adjacent the rounded portion 44. A gap is formed between the D-shaped pick roller section 42 and the pad 40 when a flat portion 46 of the D-shaped section 42 is adjacent or aligned with the pad 40.

Figure 7:
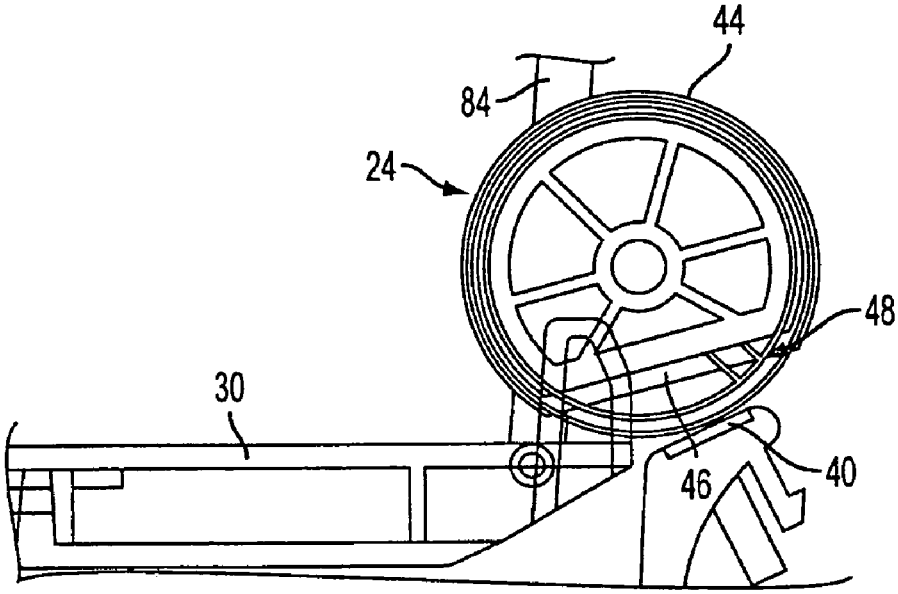
FIG. 7 is an elevational view of the pick roller, the lift plate and a friction pad mounted to the frame of the printer device.

With continued reference to FIG. 7, the D-shaped pick roller section 42 is particularly suitable for paper picking, i.e., removing and advancing only a top sheet from a stack of print media, because only a single revolution is needed from the D-shaped section 42. The D-shaped section 42 is in a pick roller home position (shown in FIG. 7) when the flat portion 46 is aligned or positioned adjacent the separator pad 40. To pick a sheet of print media, the pick roller 24 is rotated in a first direction (counterclockwise in FIG. 7) so that the rounded portion 44 can contact the top sheet of print media as the lift plate 30 moves toward the raised position. The rounded portion 44 advances the top contacted sheet into the printer device 10 for further processing. Typically, when the pick roller 24 has made a complete revolution, the advanced sheet of print media will be in contact with an upstream set of rollers (not shown). As will be discussed in further detail below, once the D-shaped section 42 has made a complete revolution and has returned to the home position, the D-shaped section 42 will stop moving in the first direction. An idler wheel section 48 of the pick roller 24, which flanks each side of the D-shaped section 42, will continue to rotate as the picked sheet of media is advanced into the printer device. The idler wheel section 48 is able to freely rotate on the pick roller shaft 22 and continue to contact the print media sheet, lift plate 30 and/or the separator pad 40.

Figure 6:
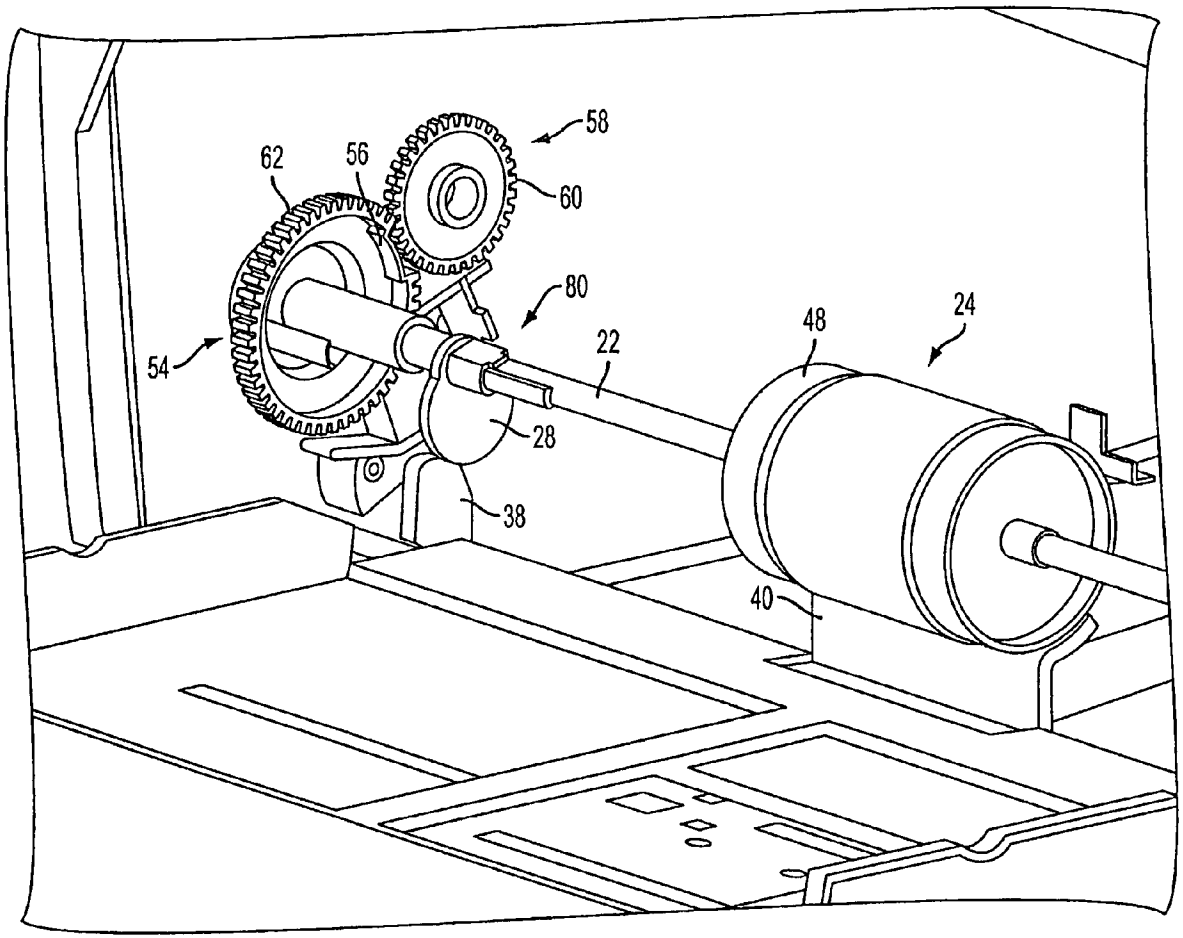
FIG. 6 is a partial perspective view of the lift plate and the pick roller shaft having a missing teeth gear adjacent an associated drive gear shown with most components of the printer device removed.

With reference to FIG. 6, a pick roller gear 54 is rotatably fixed or mounted to the pick roller shaft 22. The pick roller gear 54 includes a missing teeth section 56 that is aligned with a drive gear 58 of the printer device 10 when the pick roller gear is in a gear home position. The pick roller gear 54 is angularly oriented on the pick roller shaft 22 relative to the D-shaped pick roller section 42 such that the gear 54 is in the gear home position when the D-shaped pick roller section is in the pick roller home position. The drive gear 58 is powered through conventional means, such as an electric motor, and is able to rotate the pick roller gear 54 when teeth 60 of the drive gear 58 mesh with teeth 62 of the pick roller gear 54, i.e., when the pick roller gear 54 is not in the gear home position. With additional reference to FIGS. 8 and 10, the pick roller gear 54 includes a rib 64 having a tooth 66 adjacent an outer radial end thereof.

Figure 8:
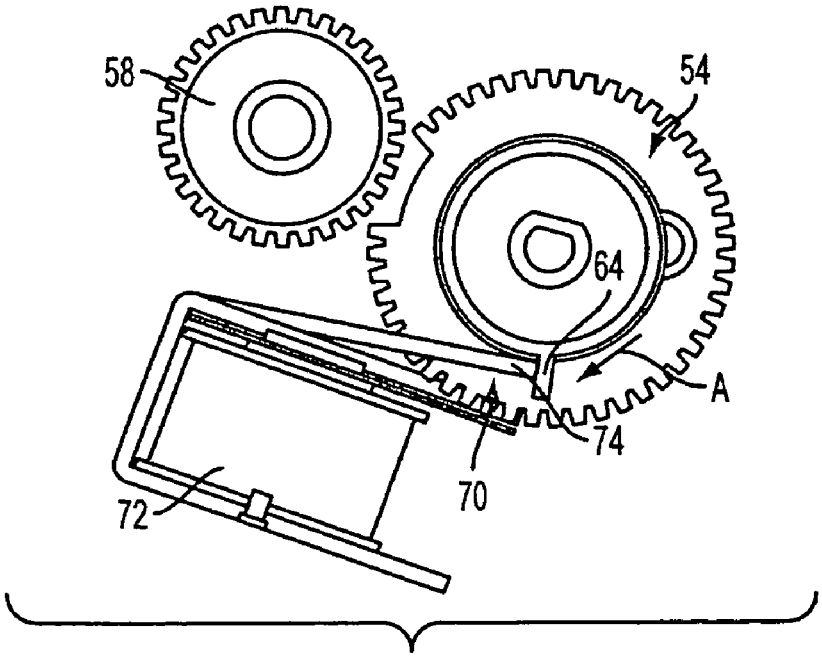
FIG. 8 is a side elevational schematic view of a missing teeth gear, a drive gear and a solenoid actuated latch pawl.
Figure 10:
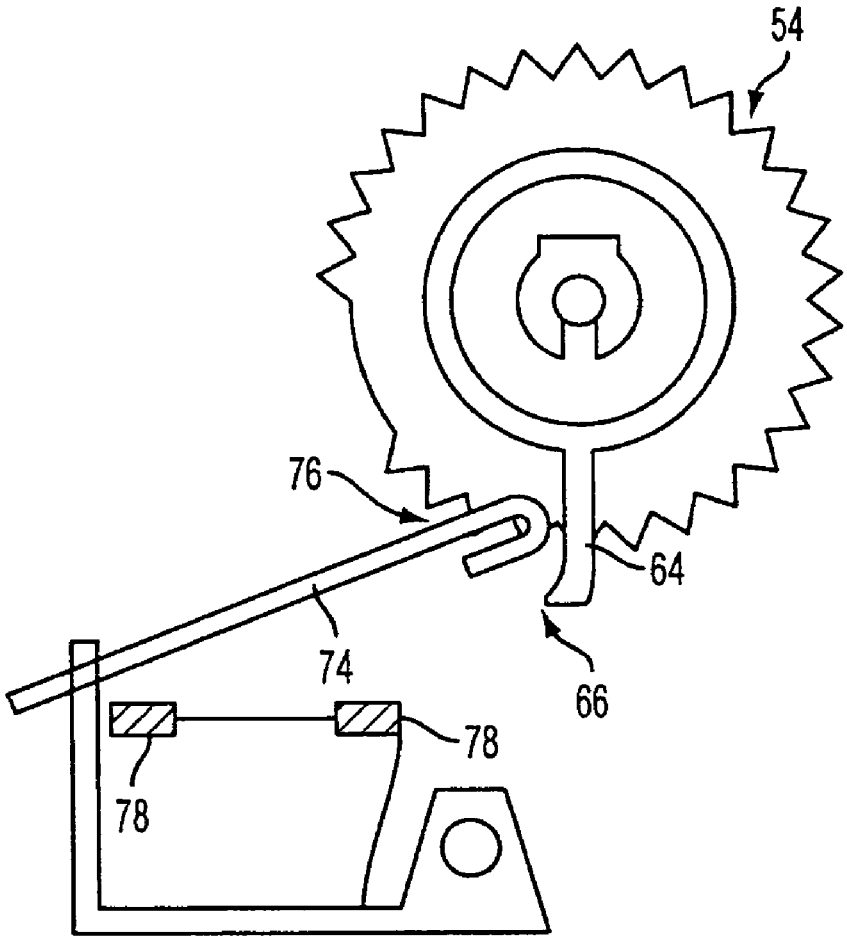
FIG. 10 is an elevational view of the missing teeth gear and the solenoid actuated latch pawl showing a tooth on a rib of the missing teeth gear, a rolled armature distal end, and pads on the solenoid.

With continued reference to FIGS. 8 and 10, the print media delivery system 18 further includes a stopping mechanism or means for maintaining the pick roller gear 54 and the pick roller section 42 in their respective home positions. In the illustrated embodiment, the stopping means includes a clutch mechanism 70 that selectively locks the pick roller gear 54 in the gear home position. More specifically, the clutch mechanism 70 includes a solenoid 72 mounted to the frame 16 and including a pawl or armature 74 that extends toward the pick roller gear 54. The pawl 74 is movable between a first pawl position (shown in FIGS. 8 and 10) wherein the pawl 74 is positioned to engage the rib 64 of the pick roller gear 54 when in the gear home position and a second pawl position wherein the pawl 74 is spaced from the gear 54 and does not obstruct rotation of the gear 54. A distal end 76 of the pawl 74 is rolled in the illustrated embodiment to reduce the likelihood of the pawl 74 catching on the rib 64 when the pawl is selectively moved from the pawl first position to the pawl second position whereas the tooth 66 of the rib 64 prevents the rolled end 76 from slipping off the rib 64 prior to selective movement of the pawl. The solenoid 72 optionally includes pads 78 that engage the pawl 74 when moved from the first position to the second position to reduce any noise associated with the pawl moving into the second position. The pads can be made of a resilient or cushioning material such as Poron®, other microporous polyurethane foams or the like.

With reference to FIGS. 5–8, the print media and delivery system 18 also includes a gear bias system 80 that urges the pick roller gear 54 to rotate in the first direction (counterclockwise in FIG. 6; clockwise in FIG. 8) when the door body 14 is in the door closed position and the tray 20 is in the tray open position. The urging of the pick roller gear 54 in the first direction is selectively used to advance the missing teeth section 56 past the drive gear 58 to allow the teeth 60 of the pick roller gear 54 to mesh with and engage the teeth 62 of the drive gear 58. The gear bias system 80 includes a bias mechanism or means, which in the illustrated embodiment is a pair of springs: first spring 82 and second spring 84; the clutch mechanism 70 including the selectively movable armature or pawl 74; the cams 26,28; and the cam followers 36,38 of the lift plate 30.

Figure 5:
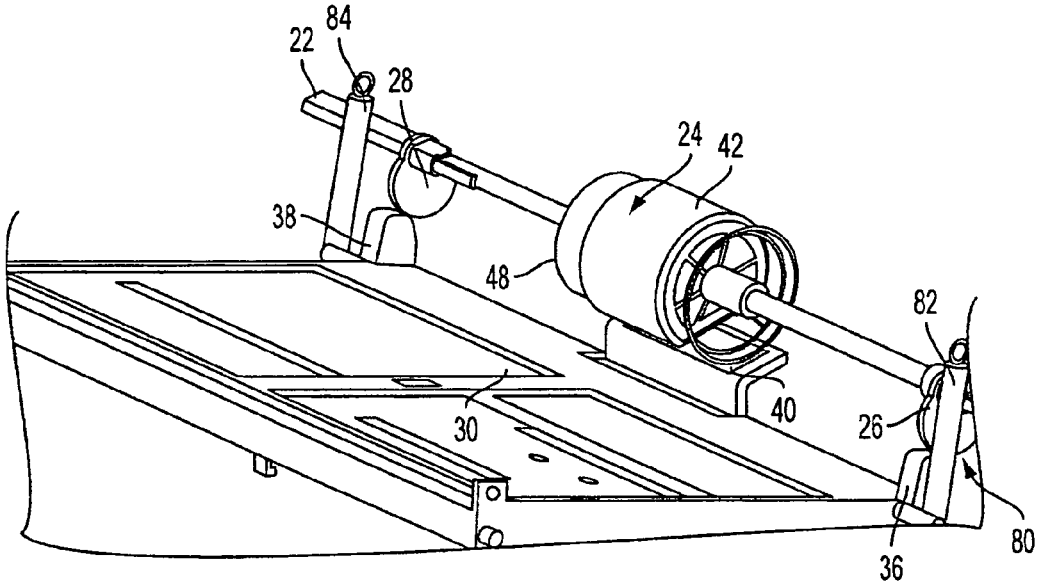
FIG. 5 is a partial perspective view of the lift plate and the pick roller shaft shown with most components of the printer device removed to reveal lift plate springs.

More specifically, with specific reference to FIG. 5, the first and second springs 82,84 extend between the lift plate 30 and the door body 14. The springs 82,84 urge the cam followers 36,38 against or into the cams 26,28. The profile of the cams 26,28 and the orientation of the cam followers 36,38 relative to the cams urge the shaft 22 and the gear 54 fixed thereon to rotate in the first direction when the missing teeth section 56 is aligned with the drive gear 58. The springs 82,84 maintain engagement between the cams 26,28 and the cam followers 36,38 and also urge the lift plate 30 toward the raised position when the tray 20 is in the tray open position. The cams 26,28 maintain the lift plate 30 in the lower position when the gear 54 is in the home position but allow the urging of the lift plate 30 toward the raised position to move the lift plate into the raised position as the gear 54 is rotated which raises any print media sheets on the lift plate 30 toward the pick roller 24. Thus, the force exerted by the springs 82,84 acts through the engagement between the cams 26,28 and the cam followers 36,38. In the illustrated embodiment, the forces exerted by the springs 82,84 are the only forces urging the shaft 22 to rotate in the first direction.

Figure 11:
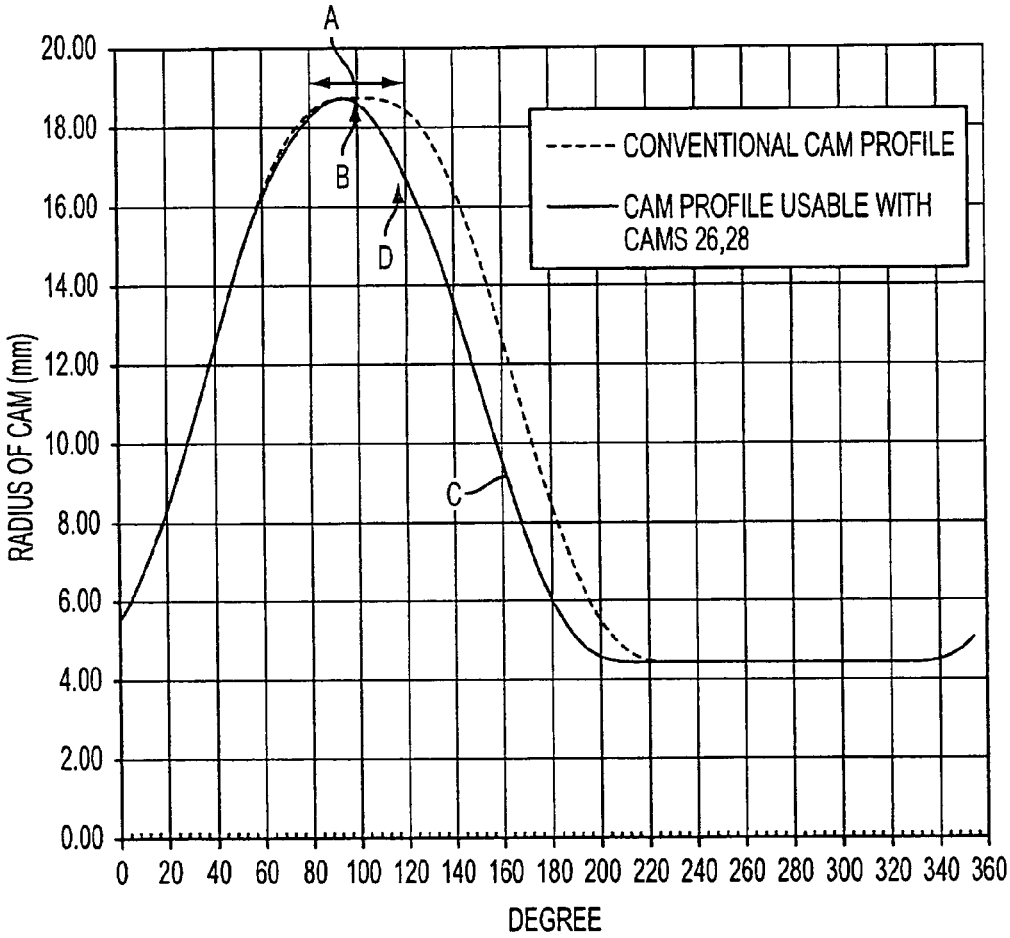
FIG. 11 is a graph comparing a conventional cam profile to a cam profile according to one embodiment.

More specifically, the cams 26,28 have profiles that covert the force exerted by the springs 82,84 to provide a moment to rotate the pick roller 24. With additional reference to FIG. 11, in a conventional cam, there is often a flat area or an area of a substantially constant radius A. When the pick roller 24 is in the home position, with a conventional cam profile, the cam followers 36,38 would rest against the cam in about the middle B of the flat spot A and no or very little moment would be created. In the embodiment described herein, the cams 26,28 can have a profile C that converts the force exerted by the springs 82,84 to provide a moment to the pick roller 24. More particularly, when the pick roller 24 is in the home position, the cam followers 36,38 contact portions D of the cams 26,28 that are reducing in radius which provides the moment to urge rotation of the pick roller 24 in the first direction.

The urging of the shaft 22 in the first direction when the gear 54 is in the gear home position works in conjunction with the clutch mechanism 70 to selectively rotate the pick roller 24. More particularly, with reference to FIG. 8, when the gear 54 is in the gear home position, the springs 82,84 acting through the cams and cam followers urge the gear to rotate in the first direction (illustrated by Arrow A in FIG. 8). Despite the urging, the pawl 74 of the clutch mechanism 70 in the pawl first position engaged with the rib 64 of the gear 54 prevents the gear 54 from rotating which prevents the gear 54 from engaging and being driven by the drive gear 58. When the solenoid 72 is actuated, the pawl moves to the pawl second position and the urging of the gear 54 is allowed to rotate the gear into engagement with the drive gear 58. Thus, the pawl 74 limits rotation of the gear 54 in the first direction when the pawl 74 is in the pawl first position and the gear 54 is in the gear home position and allows rotation of the gear 54 in the first direction when in the pawl second position. As already mentioned, when the gear 54 rotates, the cams 26,28 also permit the lift plate 30 to be moved toward the raised position.

Because the solenoid 72 is attached to the frame 16 and the pick roller gear 54 is attached to the door body 14, the pawl 74 does not maintain the gear 54 in the gear home position when the door body 14 is in the door open position. More specifically, when the door body 14 is in the door open position, the pawl 74 is disengaged from the gear 54 irrespective of which position, the pawl first position or the pawl second position, that the pawl is in. To prevent the pick roller gear 54 from moving from the gear home position when the door body 14 is open, the stopping means includes a locking mechanism that locks the pick roller gear 54 in the home position even when the door body 14 is in the door open position. More specifically, with reference to FIG. 9, the pick roller gear 54 includes a resilient arm 90 and the door body 14 includes a notch structure 92 having a distal edge 94 including a V-shaped notch 96.

Figure 9:
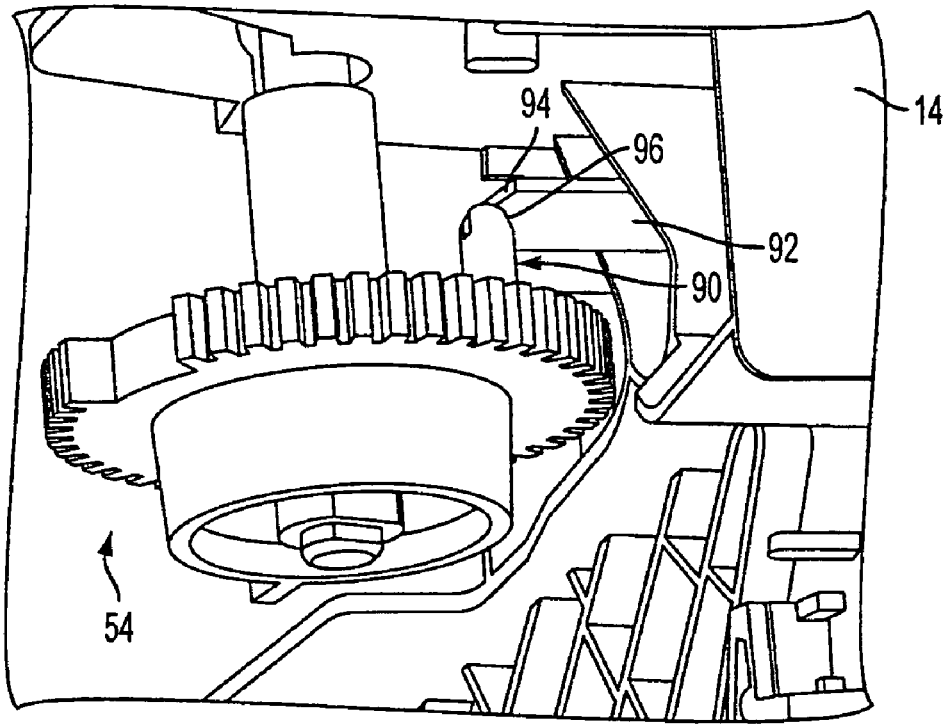
FIG. 9 is a partial perspective view of the missing teeth gear showing a resilient arm formed on the missing teeth gear engaged in a notch defined in a notch structure of the door assembly.

When the pick roller gear 54 is in the gear home position, the resilient arm 90 rests in the notch 96 (as shown in FIG. 9) thereby maintaining the missing teeth section 56 in alignment with the drive gear 58, even when the door body 14 is in the door open position. The V-shape of the notch 96 urges the pick roller gear 54 toward the gear home position, particularly when the pick roller gear is initially rotated away from the home position, and maintains the pick roller gear in the gear home position. The resilient arm 90 can be moved out of the notch 96 and beyond the notch structure when a sufficient force is applied to the pick roller gear 54. For example, when the door body 14 is in the door closed position and the springs 82,84 urge the gear 54 to rotate in the first direction, provided the pawl 74 is in the pawl second position, the urging caused by the springs is sufficient to move the resilient arm 90 from the notch 96 past the notch structure 92 and to cause engagement between the teeth of the pick roller and the drive shaft. Generally, no force is applied to the resilient arm 90 except that of the springs 82,84 when the solenoid 72 is actuated which increases the useful life of the arm.

Having a stopping means that maintains the pick roller 24 in the pick roller home position without requiring a solenoid to be mounted on the door body reduces the overall manufacturing cost of the printer device 10, reduces the complexity of the design and improves the overall safety. Moreover, using the same springs 82,84 for urging the lift plate 30 and for urging rotation of the pick roller shaft further reduces manufacturing costs. If a print media jam occurs, the door body 14 is opened which separates the pick roller 24 from the separator 40 allowing for relatively easy access for jam removal without allowing the pick roller 24 to move from its home position.

In operation, when the pick roller 24 is in the pick roller home position and held in that position, a drive shaft (not shown) associated with the drive gear 58 can be used for other, unrelated functions. When desirable to pick a sheet from the tray 20, the solenoid is actuated which moves the pawl 74 to the pawl second position. The bias force acting from the springs 82,84 and through the cams 26,28 and cam followers 36,38 rotates the shaft 22 and allows the drive gear 58 to engage the pick roller gear 54. The D-section 42 rotates once and is caught by the pawl 74 on its way around (the pawl is generally urged toward the pawl first position so immediately after actuation it moves back toward the pawl first position). Thus, the pick roller 24 is selectively maintained in its home position until desirable to actuate, even when the door body 14 is in the door open position.

The exemplary embodiment has been described with reference to the embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A door assembly connected to an associated frame and having a print media delivery system, comprising:

a door body openable to provide access into an associated frame;

a tray pivotally connected to said door body for receiving associated print media thereon;

a pick roller rotatably mounted to said door body for contacting said associated print media and advancing said associated print media into said associated frame;

a gear having a missing teeth section and connected to said pick roller for rotation therewith, said gear includes a resilient arm;

a gear bias system that urges said gear to rotate in a first direction when said door body is closed to selectively advance said missing teeth section past an associated drive gear and allow teeth of said gear to engage said associated drive gear; and wherein said resilient arm rests in a notch of a notch structure disposed on said door body when said missing teeth section is aligned with said associated drive gear and maintains said missing teeth section in alignment with said associated drive gear when said door body is open.

2. The printing device of claim 1 wherein the multipurpose tray includes a lift plate having a cam follower and is movable between a raised position and a lowered position, a cam mounted for rotation with said pick roller and engagement with said cam follower, a spring extends between said lift plate and said associated frame and urges said lift plate toward said raised position for pushing said printable media received on said multipurpose tray into engagement with said pick roller.

3. The printing device of claim 2 wherein a force exerted by said spring acts through said engagement between said cam and said cam follower to urge said pick roller shaft to rotate in said first direction when said missing teeth section is aligned with said associated drive gear.

4. The printing device of claim 3 wherein said cam has a profile including a portion that is decreasing in radius for engagement by said cam follower when said missing teeth section is aligned with said associated drive gear.

5. The printing device of claim 1 wherein a separator pad is disposed on said associated frame adjacent said pick roller when said door body is closed to form a nip between said pick roller and said separator pad and separated from said pick roller when said door body is open.

6. A printing device having a multipurpose tray for accepting various types of printable media therein, comprising:

a frame;

a door assembly including a door body pivotally connected to said frame and moveable relative to said frame between a door closed position and a door open position for providing access within said frame;

a multipurpose tray pivotally connected to said door body and moveable relative to said door body between a tray closed position and a tray open position for receiving printable media thereon when said door body is in said door closed position, said multipurpose tray including a lift plate having a cam follower and moveable between a raised position and a lowered position;

a pick roller shaft rotatably mounted to said door body, said pick roller shaft having a cam and a pick roller, said cam having a profile including a portion decreasing in radius, said cam engaged by said cam follower when said door body is in said door closed position and said multipurpose tray is in said tray open position, said decreasing radius portion engaged by said cam follower when said pick roller gear is in said home position;

a spring extending between said lift plate and said frame and urging said lift plate toward said raised position for pushing said printable media received on said multipurpose tray into engagement with said pick roller;

a pick roller gear mounted on said pick roller shaft and having a missing teeth section and a rib, said missing teeth section aligned with an associated drive gear when said pick roller gear is in a home position, engagement between said cam and said cam follower maintaining said lift plate in said lowered position when said pick roller gear is in said home position and a force exerted by said spring acts through said engagement to urge said pick roller shaft to rotate in said first direction when said pick roller gear is in said home position, said engagement between said cam and said cam follower moving said lift plate toward said raised position when said pick roller shaft is rotated in a first direction from said home position; and a clutch mechanism mounted to said frame and including a pawl moveable between a pawl first position and a pawl second position, said rib of said pick roller gear preventing teeth of said pick roller gear from engaging said associated drive gear when (1) said pawl is in said pawl first position and said pick roller gear is in said home position and (2) said door body is in said door closed position, said urging of said pick roller shaft in said first direction when said pick roller gear is in said home position causing engagement between said teeth of said pick roller gear and said associated drive gear when said pawl is in said pawl second position.

7. The printing device of claim 6 wherein a separator pad is disposed on said frame adjacent said pick roller when said door body is in said door closed position to form a nip between said pick roller and said separator pad and separated from said pick roller when said door body is in said door open position.

8. The printing device of claim 6 wherein said pick roller includes a D-shaped section and an idler wheel section, said D-shaped section includes a flat portion that is aligned with said separator pad when said pick roller gear is in said home position.

9. The printing device of claim 6 wherein said rib includes a tooth adjacent an outer radial end of said rib.

10. The printing device of claim 6 wherein said pawl is an armature having an integral rolled section adjacent a distal end thereof.

11. The printing device of claim 6 wherein said frame includes pads for engaging said pawl when said pawl is moved into said pawl second position for reducing noise associated with said pawl when said pawl is moved into said second position from said first position.

12. A printing device having a multipurpose tray for accepting various types of printable media therein, comprising:

a frame;

a door assembly including a door body pivotally connected to said frame and moveable relative to said frame between a door closed position and a door open position for providing access within said frame;

a multipurpose tray pivotally connected to said door body and moveable relative to said door body between a tray closed position and a tray open position for receiving printable media thereon when said door body is in said door closed position, said multipurpose tray including a lift plate having a cam follower and moveable between a raised position and a lowered position;

a pick roller shaft rotatably mounted to said door body, said pick roller shaft having a cam and a pick roller, said cam engaged by said cam follower when said door body is in said door closed position and said multipurpose tray is in said tray open position;

a pick roller gear mounted on said pick roller shaft and having a missing teeth section and a rib, said missing teeth section aligned with an associated drive gear when said pick roller gear is in a home position, engagement between said cam and said cam follower maintaining said lift plate in said lowered position when said pick roller gear is in said home position and urging said pick roller shaft to rotate in said first direction when said pick roller gear is in said home position, said engagement between said cam and said cam follower moving said lift plate toward said raised position when said pick roller shaft is rotated in a first direction from said home position;

a clutch mechanism mounted to said frame and including a pawl moveable between a pawl first position and a pawl second position, said rib of said pick roller gear preventing teeth of said pick roller gear from engaging said associated drive gear when (1) said pawl is in said pawl first position and said pick roller gear is in said home position and (2) said door body is in said door closed position, said urging said pick roller shaft in said first direction when said pick roller gear is in said home position causing engagement between said teeth of said pick roller gear and said associated drive gear when said pawl is in said pawl second position;

a locking mechanism for locking the pick roller gear in said home position when said door body is moved toward said door open position wherein said pawl no longer engages said rib on said pick roller gear;

the locking mechanism includes;

a resilient arm formed on said pick roller gear; and a notch structure of said door body having an edge that includes a notch therein that receives said resilient arm when said pick roller gear is in said home position.

13. The printing device of claim 12 wherein said notch is V-shaped to urge said pick roller gear toward said home position when said pick roller gear is initially rotated away from said home position.

14. The printing device of claim 12 wherein said urging of said pick roller shaft in said first direction by said engagement between said cam and said cam follower when said pick roller gear is in said home position is sufficient to move said resilient arm from said notch and past said notch structure to allow said engagement between said teeth of said pick roller and said associated drive shaft when said pawl is in said pawl second position.

15. A door assembly having print media delivery system and pivotally connected to an associated frame, comprising: a door body openable to provide access into an associated frame;

a tray pivotally connected to said door body for receiving associated print media thereon;

a pick roller rotatably mounted to said door body for contacting said associated print media and advancing said associated print media into said associated frame;

a gear having a missing teeth section and connected to said pick roller for corotation therewith;

a bias mechanism urging said gear to rotate in a first direction when said door is closed; and a resilient arm disposed on one of said gear and said door that engages a notch defined in a notch structure disposed on the other of said gear and said door to hold said gear in a home position when said door is open and said missing teeth section is in alignment with an associated drive dear.

16. The door assembly of claim 15 wherein said bias mechanism includes:

a cam connected to said pick roller for corotation therewith;

said tray including a lift plate having a cam follower that engages said cam when said tray is in a tray open position and said door body is in a door open position;

a spring extending between said lift plate and a door body urging said cam follower against said cam thereby urging said gear to rotate in said first direction when said missing teeth section is aligned with said associated drive gear.

17. The door assembly of claim 16 wherein a force exerted by said spring acts through engagement between said cam and said cam follower to urge said pick roller shaft to rotate in said first direction when said missing teeth section is aligned with said associated drive gear.

18. The door assembly of claim 17 wherein said cam has a profile with a portion decreasing in radius that is engaged by said cam follower when said missing teeth section is aligned with said associated drive gear.

19. The door assembly of claim 15 wherein a separator pad is disposed on said associated frame adjacent said pick roller when said door body is closed to form a nip between said pick roller and said separator pad and separated from said pick roller when said door body is open.

20. The door assembly of claim 19 wherein said pick roller includes a D-shaped section and an idler wheel section, said D-shaped section includes a flat portion that is aligned with said separator pad when said pick roller gear is aligned with said associated drive gear.

21. The door assembly of claim 15 wherein said notch is V-shaped to urge said pick roller gear toward a position wherein said missing teeth section is aligned with said associated drive gear when said pick roller gear is initially rotated away from said position.

* * * * *